US005746665A

United States Patent [19]

Wenker

[11] Patent Number: 5,746,665

[45] Date of Patent: May 5, 1998

[54] GOLF PUTTER

[76] Inventor: Jack A. Wenker, 1727 Huntley Rd., Goshen, Ohio 45122

[21] Appl. No.: 772,580

[22] Filed: Dec. 26, 1996

[51] Int. Cl.[6] ..... A63B 53/00; A63B 69/36

[52] U.S. Cl. ..... 473/313; 473/314; 473/340; 473/409

[58] Field of Search ..... 473/313, 314, 473/328, 316, 294, 246, 248, 251, 242, 243, 231, 219, 223, 409

[56] References Cited

U.S. PATENT DOCUMENTS

| | | | |
|---|---|---|---|
| D. 130,590 | 12/1941 | McWhirter | 473/328 |
| D. 162,054 | 2/1951 | Markovich | 473/328 |
| 2,820,638 | 1/1958 | Morrison | 473/313 |
| 3,066,936 | 12/1962 | Hyde | 473/313 |
| 3,191,936 | 6/1965 | Guier | 473/313 |
| 3,679,207 | 7/1972 | Florian | 473/294 |
| 4,426,083 | 1/1984 | Dishner | 473/294 |
| 5,470,063 | 11/1995 | Fisher | 473/251 |

FOREIGN PATENT DOCUMENTS

| | | | |
|---|---|---|---|
| 404327862 | 11/1992 | Japan | 273/80 C |
| 406154365 | 6/1994 | Japan | 273/80 C |

*Primary Examiner*—Sebastiano Passaniti

[57] ABSTRACT

A new Golf Putter for improving a golfer's putting. The inventive device includes a mallet-style putting head and an elongated shaft attached thereto. The shaft includes a first portion extending at an angle from the top of the putting head and a second portion extending at a large angle, preferably 166 degrees, from the first portion. The large angle places the golfer a longer distance from the ball, allowing a better line of sight for putts and a more consistent putting stroke.

12 Claims, 2 Drawing Sheets

GOLF PUTTER

BACKGROUND OF THE INVENTION

1. Field of the Invention

The present invention relates to golf putters and more particularly pertains to a new golf putter for improving a golfer's putting.

2. Description of the Prior Art

The use of golf putters is known in the prior art. More specifically, golf putters heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf putters include U.S. Pat. No. 5,383,664; U.S. Pat. No. 5,275,409; U.S. Pat. Des. No. 325,948; U.S. Pat. No. 5,322,285; U.S. Pat. No. 5,133,555 and U.S. Pat. Des. No. 324,250. In these prior art putters, the golfer is located very close to the ball in the golfers putting stance. In some instances, the golfers head is located directly above the ball. Some golfers find that it is difficult to line up their putts in this position. Additionally, many golfers will lift the putter head too high or stub it on the ground during the putting stroke with these conventional putters, thus preventing an effective putting stroke.

While these devices fulfill their respective, particular objectives and requirements, the aforementioned patents do not disclose a new Golf Putter. The inventive device includes a mallet-style putting head and an elongated shaft attached thereto. The shaft includes a first portion extending at an angle from the top of the putting head and a second portion extending at a large angle, preferably 166 degrees, from the first portion. The large angle places the golfer a longer distance from the ball, allowing a better line of sight for putts and a more consistent putting stroke.

In these respects, the golf putter according to the present invention substantially departs from the conventional concepts and designs of the prior art, and in so doing provides an apparatus primarily developed for the purpose of improving a golfer's putting.

SUMMARY OF THE INVENTION

In view of the foregoing disadvantages inherent in the known types of golf putters now present in the prior art, the present invention provides a new golf putter construction wherein the same can be utilized for improving a golfer's putting.

The general purpose of the present invention, which will be described subsequently in greater detail, is to provide a new golf putter apparatus and method which has many of the advantages of the golf putters mentioned heretofore and many novel features that result in a new golf putter which is not anticipated, rendered obvious, suggested, or even implied by any of the prior art golf putters, either alone or in any combination thereof.

To attain this, the present invention generally comprises a mallet-style putting head and an elongated shaft attached thereto. The shaft includes a first portion extending at an angle from the top of the putting head and a second portion extending at a large angle, preferably 166 degrees, from the first portion. The large angle places the golfer a longer distance from the ball, allowing a better line of sight for putts and a more consistent putting stroke.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf putter apparatus and method which has many of the advantages of the golf putters mentioned heretofore and many novel features that result in a new golf putter which is not anticipated, rendered obvious, suggested, or even implied by any of the prior art golf putters, either alone or in any combination thereof.

It is another object of the present invention to provide a new golf putter which may be easily and efficiently manufactured and marketed.

It is a further object of the present invention to provide a new golf putter which is of a durable and reliable construction.

An even further object of the present invention is to provide a new golf putter which is susceptible of a low cost of manufacture with regard to both materials and labor, and which accordingly is then susceptible of low prices of sale to the consuming public, thereby making such golf putter economically available to the buying public.

Still yet another object of the present invention is to provide a new golf putter which provides in the apparatuses and methods of the prior art some of the advantages thereof, while simultaneously overcoming some of the disadvantages normally associated therewith.

Still another object of the present invention is to provide a new golf putter for improving a golfer's putting.

Yet another object of the present invention is to provide a new golf putter which includes a mallet-style putting head and an elongated shaft attached thereto. The shaft includes a first portion extending at an angle from the top of the putting head and a second portion extending at a large angle, preferably 166 degrees, from the first portion. The large angle places the golfer a longer distance from the ball, allowing a better line of sight for putts and a more consistent putting stroke.

Still yet another object of the present invention is to provide a new golf putter that prevents stubbing of the putter head against the ground, which contributes to consistently solid contact with the ball.

Even still another object of the present invention is to provide a new Golf Putter that helps keep a golfers head down during the putting stroke.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
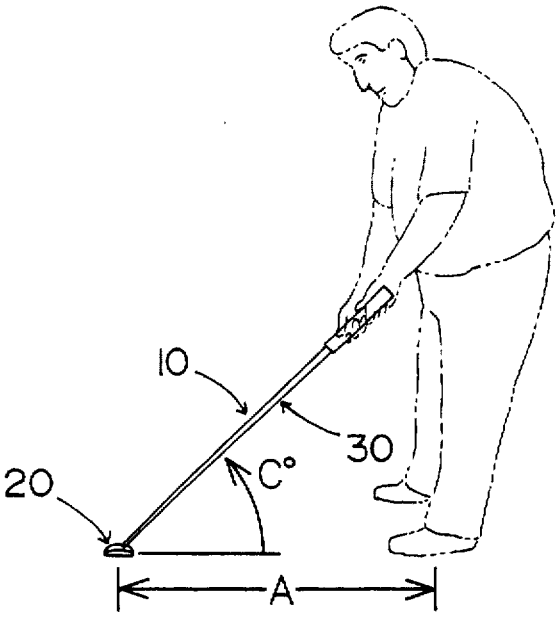
FIG. 1 is a view of a new golf putter according to the present invention in use.

With reference now to the drawings, and in particular to FIGS. 1 through 5 thereof, new golf putters embodying the principles and concepts of the present invention and generally designated by the reference numerals 10,10*a* will be described.

More specifically, it will be noted that the golf putters 10,10*a* comprise putter heads 20,20*a* and elongated putter shafts 30,30*a*.

Figure 3:
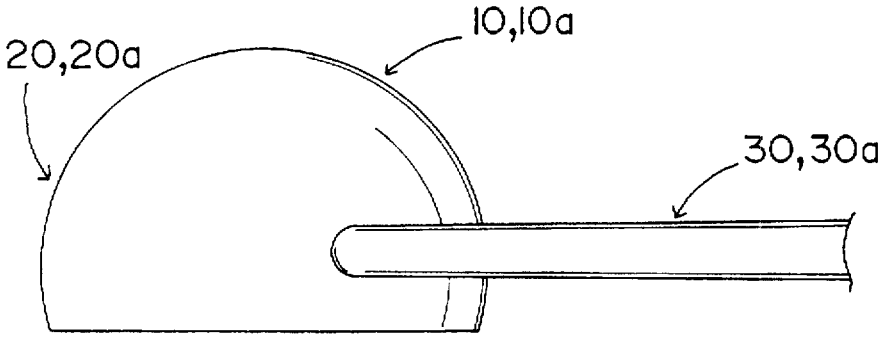
FIG. 3 is a top view of both putters.
Figure 4:
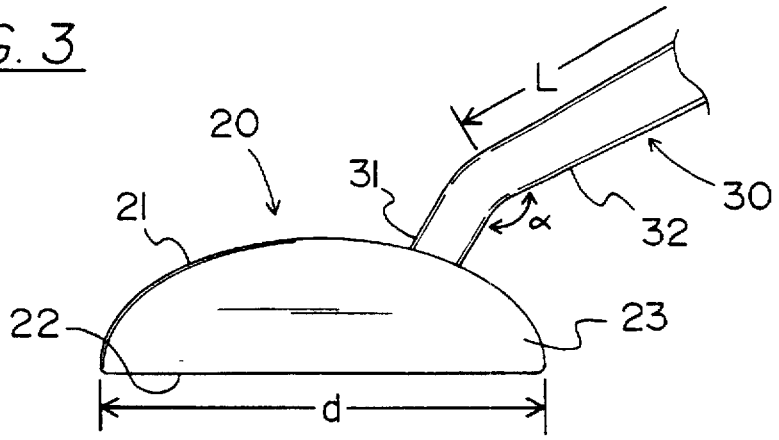
FIG. 4 is a front view of a portion of the putter in FIG. 1.

As best illustrated in FIGS. 1, 3, and 4, it can be shown that the putter 10 includes a mallet-style putting head 20. The head 20 includes a rounded top surface 21, a planar, horizontal bottom surface 22 connected to the top surface, and a flat, vertical ball striking surface 23 extending between the top 21 and bottom 22 surfaces. The ball striking surface 23 adjacent the bottom surface 22 has a maximum length "d" of 3 to 5 inches. The length tapers toward the upper surface 21, due to the curvature of the upper surface. The weight of the head 20 is between about 200 to 400 grams, preferably about 340 grams.

Figure 2:
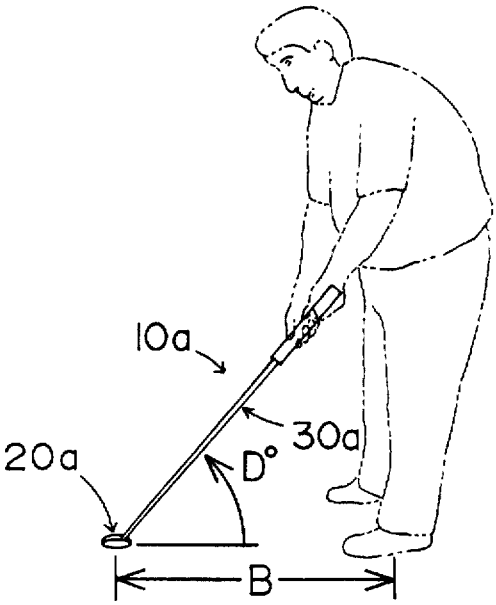
FIG. 2 is an alternate embodiment of a putter, in use.
Figure 5:
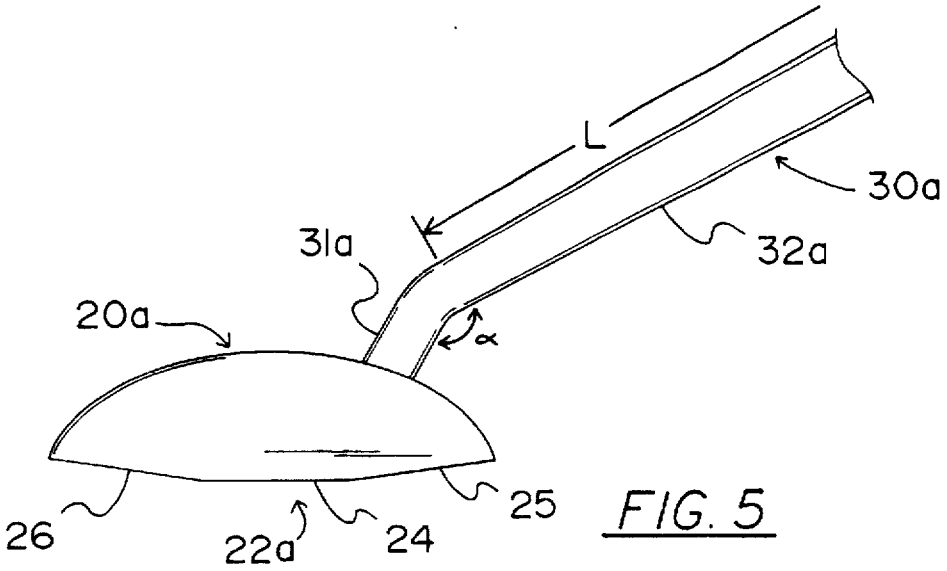
FIG. 5 is a front view of a portion of the putter in FIG. 2.

Alternatively, as best shown in FIGS. 2 and 5, the putter head 20*a*, instead of having a planar, horizontal bottom surface 22, has a bottom surface 22*a* formed of three distinct planar surface portions 24,25,26. The portion 24 is centrally located on the bottom surface 22*a*, and is generally planar and horizontal to the ground. The portions 25,26 are also planar, but extend upward at an angle from the portion 24, such that when the portion 24 is lying flat on the ground, the portions 25,26 do not contact the ground. The purpose of the three surface portions 24–26 will be later described. The putter head 20*a* is otherwise identical to the putter head 20.

Putter shaft 30 is attached to putter head 20. The putter shaft 30 includes a first portion 31 secured to the top surface 21 of head 20 and extending at an angle from the top surface 21 (relative to the horizontal bottom surface 22). Second portion 32 extends at a large angle a from the first portion 31. The angle $\alpha$ is preferably about 166 degrees. The second portion 32 has a length "L" of approximately 34 to 44 inches, preferably 44 inches. The end of the portion 32 opposite the first portion 31 can include the usual gripping surface for grasping by the golfer during the putting stroke.

The putter shaft 30*a* is similar to the shaft 30, including the angle $\alpha$ between the portions 31*a* and 32*a*, and a length "L" of 34 to 44 inches. However, the length of shaft portion 32*a* is normally smaller than portion 32, due to the different bottom surface 22*a* of putter head 20*a*.

Referring to FIG. 1, it is seen that due to the large angle $\alpha$ and the large length "L", a putting stance results which is similar to the stance taken when a golfer is about to hit a drive. The golfers feet are located a larger distance "A" from the ball, which is a substantially larger distance than a usual putting stance. The putter shaft 30 is also located at a smaller angle "C" relative to the ground, which angle is substantially smaller than in a usual putter. This position allows the golfer to keep the putter head in contact with the ground during the putting stroke without stubbing the head on the ground, keeps the putting stroke straighter, provides a larger pendulum arm to increase the force of the stroke, and permits better vision between the ball and hole.

In FIG. 2, the putter 10*a* with the shorter shaft 30*a* and putter head 20*a* is more versatile. The golfer stands at a shorter distance "B" away from the ball compared to distance "A", but still larger compared to usual putters. In addition the angle "D" is slightly larger than angle "C", but still smaller than with a usual putter. However, the putter head 20*a* allows the angle "D" to vary. If the putter is held high (e.g. a taller golfer), the shaft 30*a* is more angled relative to the ground which means that the surface portion 26 is held parallel to the ground during the putting stroke and the ball is struck on the front part of the ball striking surface. If the putter is held low (e.g. a shorter golfer), the shaft is less angled, and the surface portion 25 is parallel to the ground during the putting stroke and the ball is struck on the rear part of the ball striking surface. The surface portion 24 will be parallel to the ground with a average size golfer. In each instance the golfer takes a stance farther away from the ball than is usual with a previous putter, deriving the benefits set forth previously.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf putter comprising:

a putter head having a planar, vertically extending ball striking surface, a top surface, and a bottom surface; and an elongated shaft attached to the top surface, said shaft comprising a continuous piece bent into two portions, including a first portion extending from the top surface at a first angle less than 90 degrees relative to the bottom surface formed between the first portion and the top surface, and a second portion extending from the first portion at a second angle, said second angle being measured interiorly between the second portion and the first portion and being greater than the first angle;

wherein the second angle is fixed at approximately 166 degrees.

2. The golf putter of claim 1, wherein the second portion has a length of approximately 34 to 44 inches.

3. The golf putter of claim 2, wherein the length is approximately 44 inches.

4. The golf putter of claim 1, wherein the putter head has a weight of approximately 200 to 400 grams.

5. The golf putter of claim 4, wherein the weight is approximately 340 grams.

6. The golf putter of claim 1, wherein the ball striking surface has a maximum length of approximately 3 to 5 inches.

7. The golf putter of claim 1, wherein the bottom surface is planar in a plane perpendicular to said ball striking surface for maintaining said ball striking surface in a substantially perpendicular orientation to the ground surface of a golf green when said bottom surface is placed on the ground surface.

8. The golf putter of claim 1, wherein the bottom surface includes a center planar portion and two angled planar portions extending from the center planar portion, each said planar portion having substantially the same length perpendicular to said ball striking surface and each being oriented in a plane perpendicular to said ball striking surface for maintaining said ball striking surface in a substantially perpendicular orientation to the ground surface of a golf green when any one of said planar portions of said bottom surface is placed on the ground surface.

9. A golf putter comprising:

a putter head having a planar, vertically extending ball striking surface, a top surfaces and a bottom surface; and an elongated shaft attached to the top surface, said shaft comprising a continuous piece bent into two portions, including a first portion extending from the top surface at a first angle less than 90 degrees relative to the bottom surface formed between the first portion and the top surface, and a second portion extending from the first portion at a second angle, said second angle being measured interiorly between the second portion and the first portion and measuring approximately 166 degrees, the second portion having a length of approximately 34 to 44 inches;

wherein the bottom surface of said putter head is substantially planar for maintaining said ball striking surface in a substantially perpendicular orientation to the ground surface of a golf green when said bottom surface is placed on the ground surface.

10. The golf putter of claim 9, wherein the weight is approximately 340 grams.

11. A method of putting a golf ball on a golf green, comprising:

providing a golf putter comprising a putter head having a planar, vertically extending ball striking surface, a top surface, and a bottom surface; and an elongated shaft attached to the top surface, said shaft comprising a continuous piece bent into two portions, including a first portion extending at a first angle less than 90 degrees relative to the bottom surface from the top surface and a second portion extending from the first portion at a second angle greater than the first angle formed interiorly between the second portion and the first portion of the shaft; said bottom surface being substantially planar for maintaining said ball striking surface in a substantially perpendicular orientation to the ground surface of a golf green when said bottom surface is placed on the ground surface;

placing the bottom surface of the golf putter on the ground surface of the golf green;

swinging the golf putter with the bottom surface of the golf putter in contact with the ground surface of the golf green; and striking the golf ball with the bottom surface of the golf putter in contact with the ground surface of the golf green.

12. The method of putting a golf ball of claim 11 wherein the second portion of the golf putter has a length of approximately 44 inches and wherein the second angle is fixed at approximately 166 degrees such that the angle between the second portion of the shaft and the planar bottom surface is approximately 166 degrees, and wherein said method additionally comprises the step of positioning the feet of the player at least 40 inches from the position of the ball during the swinging of the golf putter.

* * * * *